US008546708B2

(12) United States Patent
Burnel et al.

(10) Patent No.: US 8,546,708 B2
(45) Date of Patent: Oct. 1, 2013

(54) ELECTRICAL SWITCH WITH A TACTILE EFFECT AND A DUAL ACTION

(75) Inventors: Thierry Burnel, Dole (FR); Laurent Kubat, Dole (FR)

(73) Assignee: CoActive Technologies, LLC, Newton, MA (US)

( * ) Notice: Subject to any disclaimer, the term of this patent is extended or adjusted under 35 U.S.C. 154(b) by 183 days.

(21) Appl. No.: 13/040,581

(22) Filed: Mar. 4, 2011

(65) Prior Publication Data

US 2011/0214969 A1 Sep. 8, 2011

(30) Foreign Application Priority Data

Mar. 4, 2010 (FR) ..... 10 51554

(51) Int. Cl.
*H01H 9/00* (2006.01)
*H01H 19/62* (2006.01)
*H01H 27/00* (2006.01)

(52) U.S. Cl.
USPC ..... 200/17 R

(58) Field of Classification Search
USPC ..... 200/17 R, 5 A, 16 C, 16 D, 18, 405, 200/406, 408, 409, 454, 460, 463, 465, 511, 200/512, 513, 516, 520, 521, 341
See application file for complete search history.

(56) References Cited

U.S. PATENT DOCUMENTS

| | | | | |
|---|---|---|---|---|
| 4,029,915 | A * | 6/1977 | Ojima | 708/145 |
| 4,359,614 | A | 11/1982 | Green et al. | |
| 4,385,218 | A | 5/1983 | Nishida | |
| 4,659,881 | A | 4/1987 | Dowe | |
| 5,898,147 | A | 4/1999 | Domzalski et al. | |
| 6,951,991 | B2 * | 10/2005 | Asada et al. | 200/406 |
| 7,534,972 | B2 * | 5/2009 | Tan | 200/1 R |
| 7,902,474 | B2 * | 3/2011 | Mittleman et al. | 200/516 |

FOREIGN PATENT DOCUMENTS

| | | | |
|---|---|---|---|
| EP | 1143469 | A1 | 10/2001 |
| FR | 2837320 | A1 | 9/2003 |
| JP | 55024351 | A | 2/1980 |

* cited by examiner

*Primary Examiner* — Edwin A. Leon
*Assistant Examiner* — Anthony R. Jimenez
(74) *Attorney, Agent, or Firm* — Fox Rothschild LLP

(57) ABSTRACT

A switch including a triggering member that is adapted to come to bear on two peripheral fixed contacts to make a first switchpath and that is deformable to make an electrical connection between these two fixed contacts and a central fixed contact to make a second switchpath consecutively to making the first switchpath. The triggering member may occupy an initial high rest position and a final low switching position toward which it is moved by an actuating member against a return force exerted by a spring that is disposed between the support for the contacts and the triggering member.

5 Claims, 4 Drawing Sheets

ELECTRICAL SWITCH WITH A TACTILE EFFECT AND A DUAL ACTION

RELATED APPLICATION AND CLAIM OF PRIORITY

This application claims the priority benefit of France Patent Application 1051554, filed Mar. 4, 2010, the content of which is hereby incorporated by reference in its entirety.

BACKGROUND

The present disclosure relates to an electrical switch of the type making it possible to make successively at least two electrical switchpaths by means of an actuating member which the user depresses, exerting a pressure force.

Such a control enables the user to exert successively a low first pressure to make a first switchpath and then a higher second pressure to make a second electrical switchpath.

During the first phase, the user perceives an elastic resistance and then, during the making of the second switchpath, the switch gives the user a tactile sensation of the making of that switchpath.

The tactile sensation is obtained by means of an elastically deformable triggering member, for example of dome shape, the pressure exerted on which causes a sudden change of state making it possible on the one hand to make an electrical switchpath and on the other hand to give the tactile sensation.

One such type of double-action switch, also known as a double-pressure switch, is used in numerous electronic devices and notably in cameras and video cameras in which the trigger button is actuated over an axial stroke in two stages, for example, in a first stage to bring about automatic focussing ("autofocus") and then in a second stage the actual triggering of the shutter and/or storage of the digital file.

Other applications in which it is necessary to make two electrical switchpaths successively, for example for consecutively establishing two signals, include selection followed by validation buttons and buttons for commanding the activation of a function and then the execution of that function.

Various designs have been proposed for such double-action or double-pressure switches.

U.S. Pat. No. 4,659,881, the content of which is hereby incorporated by reference, proposes a switch including two stacked coaxial domes that successively command an activation function and then a triggering function.

A second solution described in U.S. Pat. No. 5,898,147, the content of which is hereby incorporated by reference, uses two triggering members each including four superposed and interleaved radial branches.

There is further known in U.S. Pat. No. 4,359,614, the content of which is hereby incorporated by reference, a switch including a lower dome surmounted by an elastically deformable contact crossbar.

In the same family of documents, all covering at least one "fixed" lower dome, the annular lower edge of which bears on a support carrying fixed contacts, there may also be cited U.S. Pat. No. 5,564,560, the content of which is hereby incorporated by reference, which, to make the first switchpath, uses a flexible circuit with conductive lands that presses on the upper face of the dome in association with an axial actuating plunger including a mobile contact bead which, at the end of the first actuating stroke, makes a first switchpath between these conductive lands.

U.S. Pat. No. 6,498,312, the content of which is hereby incorporated by reference, proposes a "double" triggering member in one piece with two sets of radial branches, the triggering member is deformed twice in succession to make the two switchpaths.

All these solutions are particularly bulky, notably along the actuating axis, because they use two superposed domes or a plurality of superposed contact components or necessitate electrical contacts outside the area delimited by the dome.

Precise adjustment of the switch, and notably control of the actuating forces, are particularly complicated if two domes or the like are used.

U.S. Pat. No. 4,385,218, the content of which is hereby incorporated by reference, proposes a switch that includes a single dome forming a triggering member that is deformed in two successive steps to make successively a first electrical switchpath between peripheral fixed contacts and which is then deformed a second time to make a second electrical switchpath between these peripheral contacts and a central fixed contact.

In this embodiment, in which the single triggering member, or dome, is initially pressed against the bottom of the housing that receives it, the problems inherent to the overall size are at least partially solved, but the industrial realization of a dome with a particular conformation enabling double deformation thereof and the service life of such a dome subjected to large deformations are complex and lead to insufficient service life.

Here again, control of the forces felt successively by the user is also very difficult.

SUMMARY

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this document is to be construed as an admission that the embodiments described in this document are not entitled to antedate such disclosure by virtue of prior invention. As used in this document, the term "comprising" means "including, but not limited to."

To remedy the drawbacks that have just been referred to, the invention proposes a double-action tactile-effect electrical switch including an insulative support an upper face of which that lies in a horizontal plane carries at least three fixed electrical contacts including a peripheral first contact, a peripheral second contact, and a central third contact; and a triggering member, which is elastically deformable from a stable rest state by the action of an actuating member acting in a globally vertical direction, which includes a lower peripheral annular area adapted to come simultaneously into bearing engagement with the two first peripheral contacts to make a first switchpath, and a domed upper central section on which the actuating member acts, which member is deformable in order to make an electrical connection between on the one hand the two fixed first contacts and on the other hand the central third electrical contact, to make a second switchpath consecutively to the making the first switchpath. In its stable rest state, the triggering member can occupy an initial high rest position toward which it is urged elastically and in which the annular area does not bear on the two peripheral fixed first contacts i.e. a position in which there is no electrical contact or connection between the two peripheral fixed first contacts;

and a final low switching position toward which it is moved by the actuating member, against the return spring force, and in which the annular area of the triggering member bears directly or indirectly on the two first peripheral fixed contacts, i.e. a position in which the annular area of the triggering member establishes electrical contact between the two peripheral fixed first contacts.

Additionally, the switch may include a spring return member that is disposed vertically between the support and the triggering member and which is compressible globally vertically to enable the triggering member to move from its initial high position to its final low position. In the initial high position of the triggering member, the lower peripheral edge that delimits the annular area lies in a plane that forms an acute angle with the horizontal plane, and, in the low final position, the lower peripheral edge lies in a plane parallel to the horizontal plane and bears on the two first peripheral fixed contacts.

According to additional embodiments of the invention, the spring return member is a ring that includes a rigid bearing section on which a section of the lower peripheral edge bears and an elastically deformable section, this ring being elastically deformable between a stable rest state in which the rigid section lies in a plane that forms an acute angle with the horizontal plane and an elastically compressed final state in which the rigid section extends horizontally and bears on the horizontal upper face.

According to additional embodiments of the invention, the elastically deformable section of the return ring includes two elastically deformable branches which join at a point that bears on the horizontal upper face situated between the two first peripheral fixed contacts.

According to additional embodiments of the invention, the triggering member is a spherical dome.

According to additional embodiments of the invention, the switch includes a contact support for contacts that delimits a housing the bottom of which is delimited by the horizontal upper surface.

BRIEF DESCRIPTION OF THE DRAWINGS

Other features and advantages of the invention will become apparent on reading the following detailed and non-limiting description of embodiments of the invention, for an understanding of which reference should be made to the appended drawings, in which.

DETAILED DESCRIPTION

To facilitate an understanding of the following description and to make the claims clear, the terms vertical, horizontal, longitudinal, transversal, etc. are used without limiting the invention and without reference to terrestrial gravity, referring to the system of axes L, V, T shown in the figures.

In the following description, identical, similar or like components are designated by the same references.

FIGS. 1 to 6 show a double-action electrical switch 10 in the form of a discrete unitary component intended in particular to be soldered and thus fixed to a printed circuit board (PCB) 12, four parts of which are shown in the figures.

Figure 4:
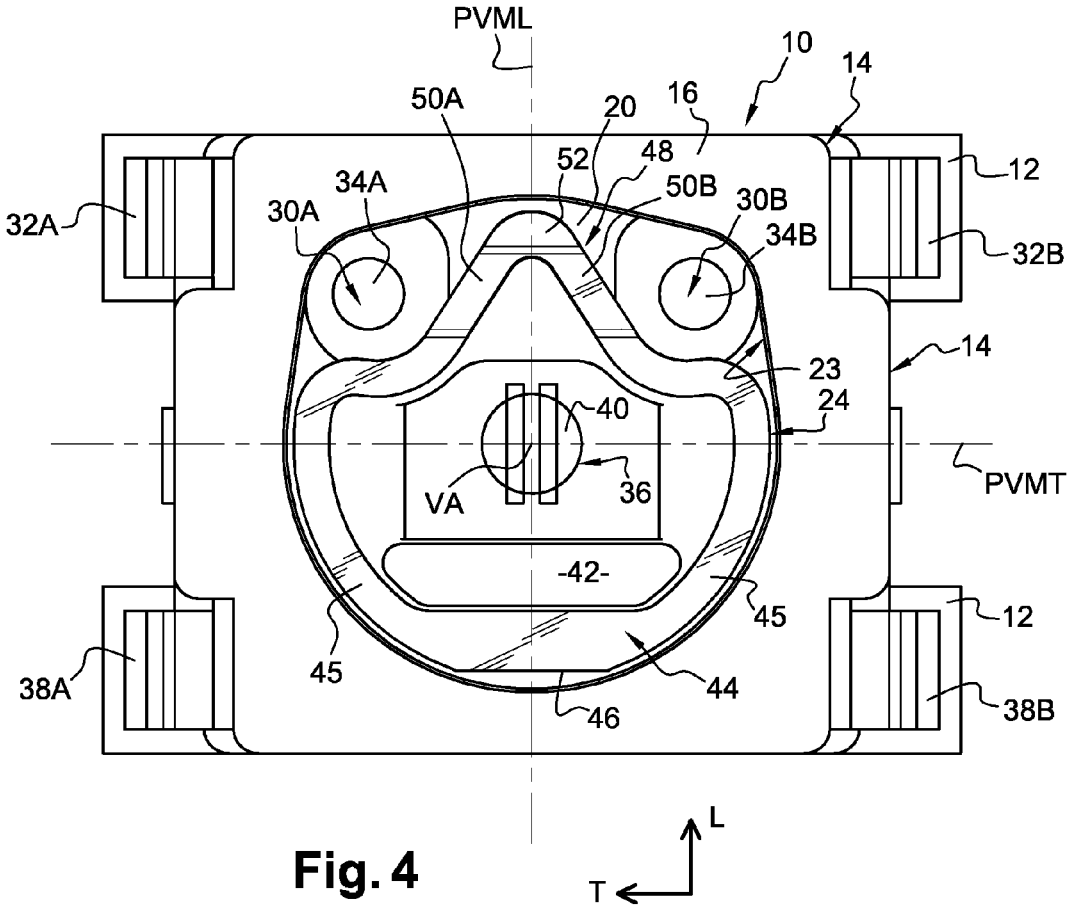
FIG. 4 illustrates a top view of the switch shown in FIG. 2.

The electrical switch 10 may have a generally symmetrical design with respect to the vertical and longitudinal median plane PVML indicated in FIG. 4. In a general manner known in the art, the switch 10 may consist of a base or casing 14 of rectangular parallelepiped general shape that is produced by molding it from an electrically insulative plastic material. The casing 14 may be notably delimited by its horizontal upper face 16 and by its horizontal lower face 18.

In its central part, the casing 14 may include a housing 20 in the upper face 16 which is open vertically upwards and is delimited by a horizontal bottom plane 22 and by a concave cylindrical vertical lateral wall 23.

With the components assembled, the housing 20 may house an annular return spring 24 and at least part of a triggering member or triggering dome 26, while here an actuating member or plunger 28 extends vertically above the plane of the upper face 16.

Figure 1:
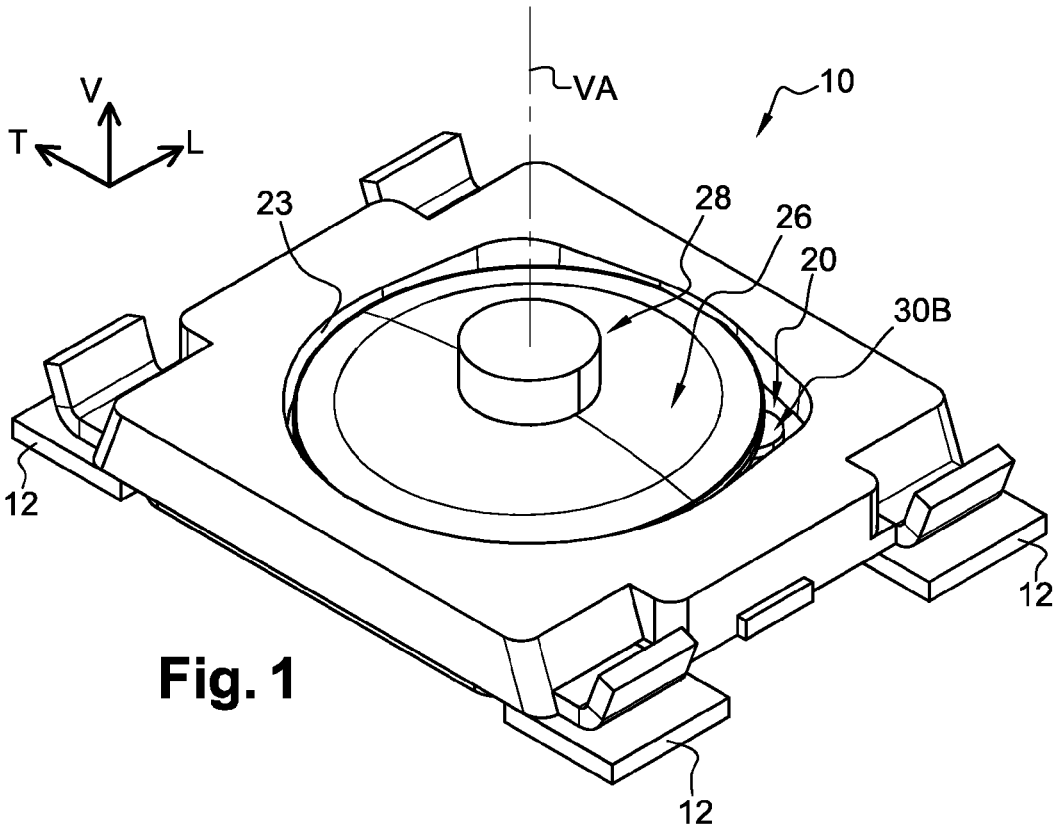
FIG. 1 illustrates a three-quarter perspective view from above of an electrical switch according to an embodiment of the invention in which the switch is represented without its upper sealing film.
Figure 2:
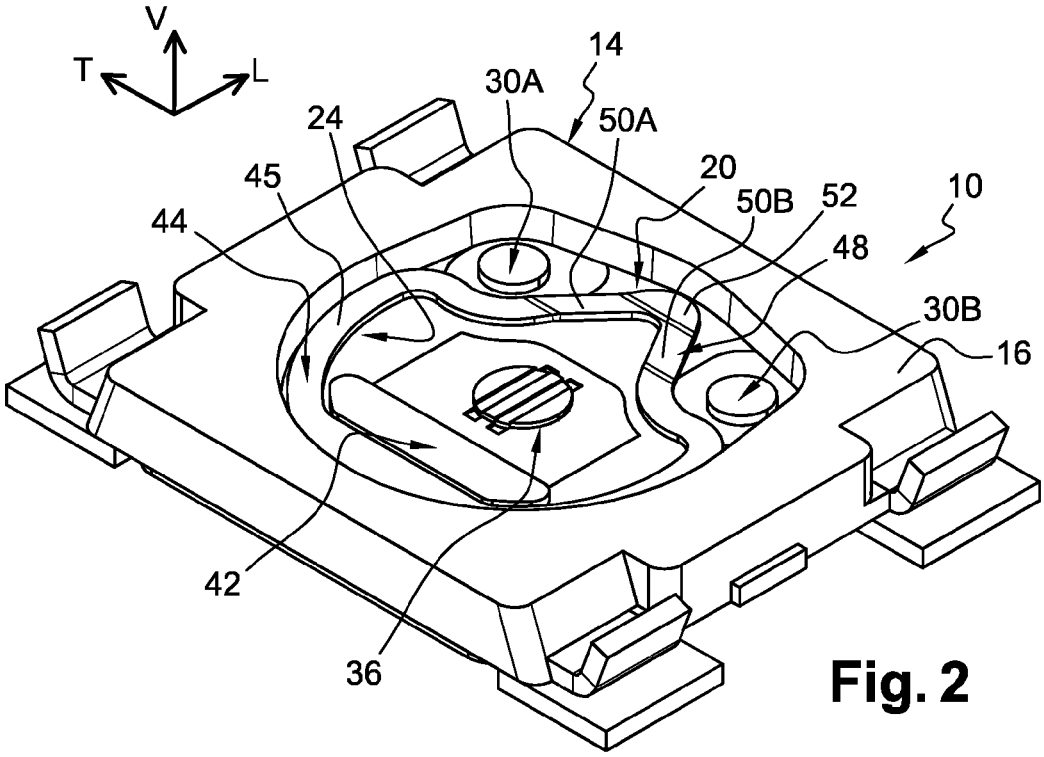
FIG. 2 illustrates a view analogous to that of FIG. 1 in which the switch is represented without its actuating plunger and without its triggering dome.
Figure 3:
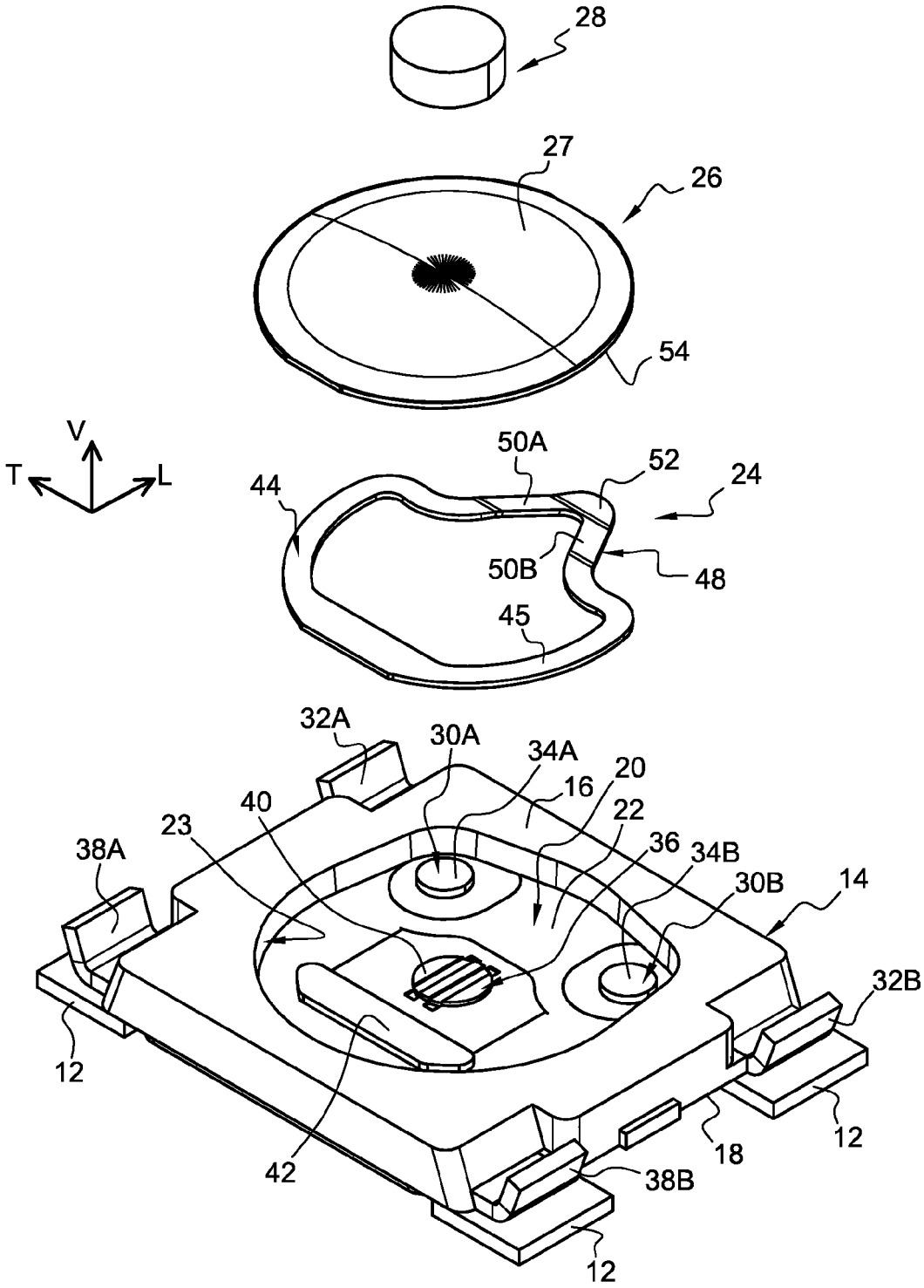
FIG. 3 illustrates an exploded perspective view in the vertical actuating direction that represents the four main components of the electrical switch from FIG. 1.

In the assembled position of the components shown in FIG. 1, the switch 10 may be covered by a closure and sealing film (not shown) that seals and closes the top of the housing 20 and to which the plunger 28 is glued.

Figure 6:
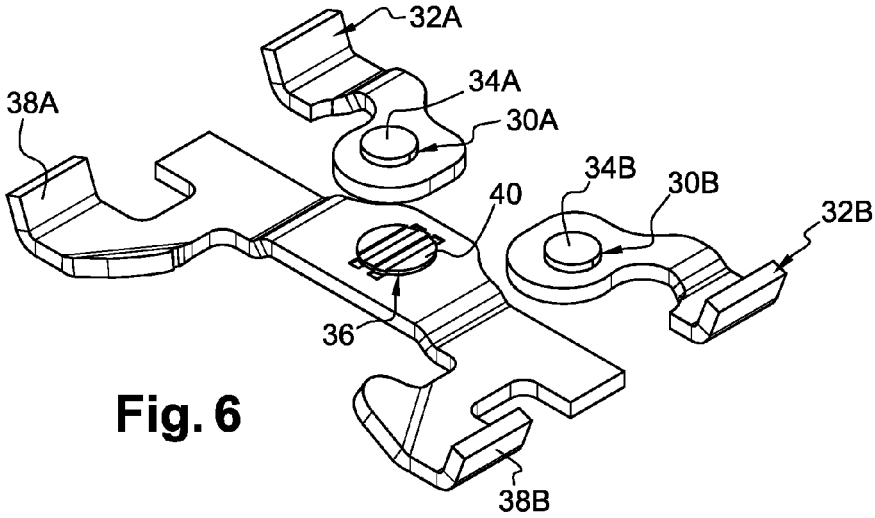
FIG. 6 is a detail view showing in perspective the metal contact bands of the switch shown in FIG. 2 in particular before molding the insulative casing.

According to a technique known in the art, the casing 14 may be molded around cut and bent metal strips, as shown in FIG. 6, that constitute the fixed contacts and the associated connecting terminals. Thus, the switch 10 may include, in the bottom of the housing 20, first and second fixed peripheral contacts 30A and 30B, each of which may be independently electrically connected to the outside by an associated connecting terminal 32A, 32B which is designed so that it can be electrically connected to a corresponding track facing it in the upper part of the printed circuit board 12.

Each peripheral fixed contact 30A, 30B may be arranged near the lateral vertical wall 23 of the housing 20 and takes the form of a circular patch which here projects vertically so that its free horizontal upper face 34A, 34B extends above the plane of the horizontal upper face that the bottom 22 of the housing 20 constitutes.

Similarly, the switch may include a central common fixed third contact 36 electrically connected to two other electrical connecting terminals 38A, 38B also intended to be connected to corresponding conductive tracks of the printed circuit board 12. The central fixed contact 36 may also be produced in the form of a circular patch, an upper face 40 of which lies in a horizontal plane at a height relative to the horizontal bottom plane 22 that is slightly less than that of the upper faces 34A and 34B.

An exemplary shape of the metal strips cut out with the fixed electrical contact patches is shown in detail in FIG. 6.

In the bottom of the housing 20, there may be a stud 42 for locating a return spring 24 which projects vertically upward and is in one piece with the molded insulative plastic material.

As may be seen in FIG. 4 in particular, a vertical lateral wall 23 of the housing 20 may include a first part with a semicircular concave cylindrical profile, at the bottom in FIG. 4, in which the stud 42 may be arranged and which is centred on the central vertical axis VA of the switch 10 which corresponds to the vertical actuating axis. The other part or half of the vertical lateral axis 23 may follow an oblong contour that passes around the first and second fixed peripheral contacts 30A and 30B.

The housing 20 may receive and locate the annular return spring 24 in an initial high rest position of the triggering dome 26. Here, the spring 24 may be a member of generally annular shape produced by cutting and bending sheet metal, for example, or by molding a plastic material resulting in the spring 24 having no electrical conduction function.

The generally annular spring 24 may include a rigid first part or section of substantially semicircular ring shape 44 which is situated in the lower half of FIG. 4 and the contour and the width of which may be complementary to the corresponding part of the vertical wall 23 of the housing 20 and the locating stud 42.

As may be seen in FIG. 5, the rigid first section may lie in a plane and the annular spring 24 bears against the horizontal bottom plane 22 via its lower edge 46, which may be transversely oriented, and which constitutes a rocking axis of the rigid section 44 during elastic deformation of the spring 24 (see below).

The complementary shapes of the stud 42 and the facing portion of the rigid section 44 and of the wall 23 of the housing 20 may locate the spring 24 in the housing with clearance, notably so that the spring cannot turn in its housing and its movements are limited to the rocking mentioned above during its elastic deformation.

A second part or section 48 of the spring 24, corresponding to the upper part of FIG. 4, extending above the median transverse vertical plane PVML, may consist essentially of two elastically deformable branches 50A and 50B that form an inverted V, joining at a tip 52.

Figure 5:
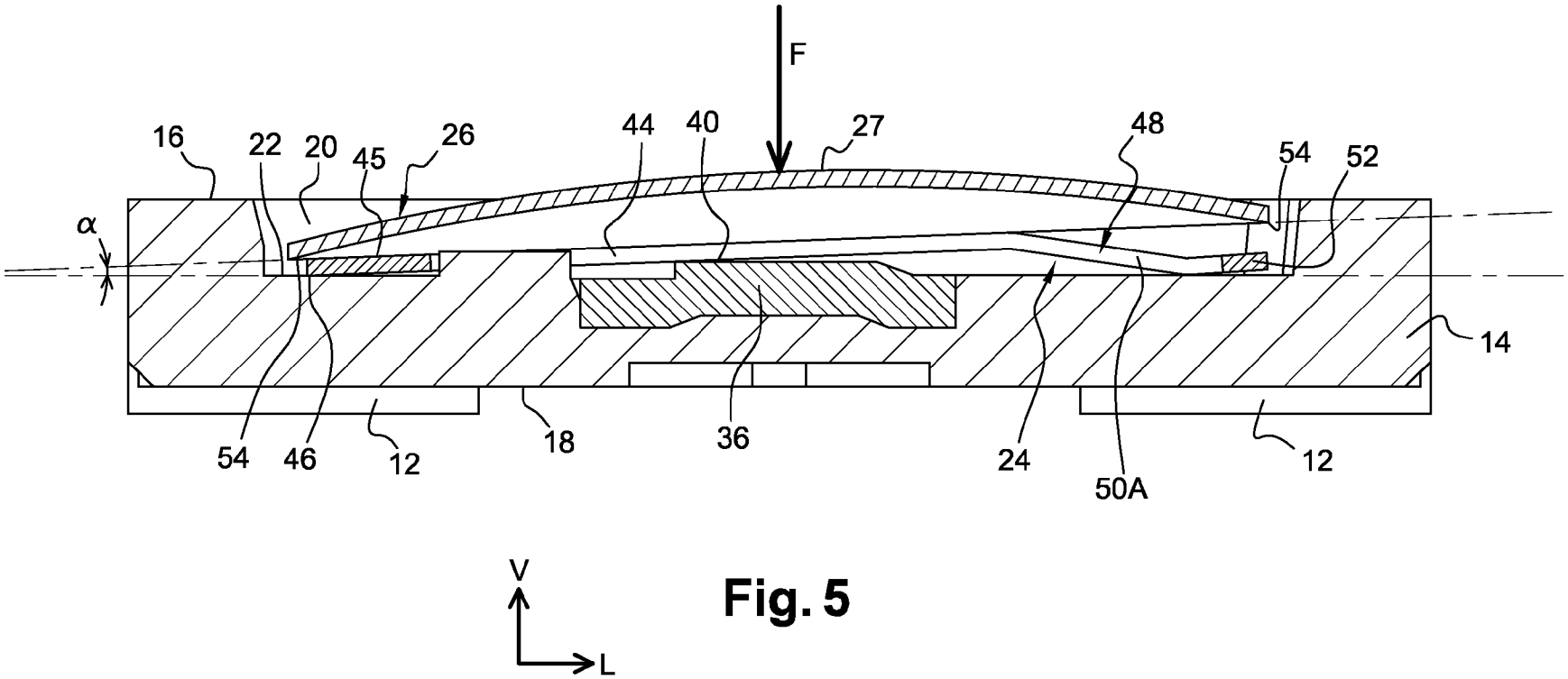
FIG. 5 is a view to a larger scale in section on a median longitudinal vertical plane of the switch from FIG. 1 without its actuating plunger.

As may be seen in FIG. 5 in particular, in the undeformed rest state of the spring 24, the branches 50A and 50B may extend out of the plane of the rigid first section 44 vertically downward in the direction of the horizontal bottom plane 22, so as to bear on the horizontal bottom plane and to confer upon the general plane of the first section 44 an orientation inclined at an angle alpha relative to the horizontal plane of the bottom 22.

Starting from the high rest position of the spring 24 shown in FIG. 5, in which the latter spring is not elastically deformed (or only very slightly deformed to take up play), if the rigid section 44 is depressed vertically, the branches 50A and 50B may flex until the plane upper face 45 of the first section 44 lies in a substantially horizontal plane, causing the spring 24 to rock about the edge 46 in the clockwise direction as seen in FIG. 5.

The semicircular annular plane upper face 45 of the first section 44 of the spring 24 may constitute a bearing plane for the lower peripheral annular area of the triggering dome 26, which here is shown as a circular contour spherical dome the concave side of which faces downward. The dimensions of the triggering dome 26, and in particular its outside diameter, are such that it is at least partly housed and located in the housing 20.

The triggering dome 26, shown in FIG. 5 as a deformable dome, the general design of which is known in the art, notably for producing a tactile effect when it is elastically deformed with a sudden change of state, may be electrically conductive, at least on its concave interior and lower face. The lower peripheral annual area of the triggering dome 26 that bears on the first section 44 of the spring 24 may include, as shown here, a peripheral lower circular edge 54.

As may be seen in FIG. 5, in the rest position of the switch 10, i.e. when a user is not exerting any force on the actuating plunger 28, the triggering dome 26 may be inclined at the angle alpha, like the spring 24, and the part of its lower edge 54 facing the upper faces 34A and 34B of the two peripheral fixed contacts 30A and 30B may be situated vertically above these faces, i.e. there is no electrical contact between the edge 54 and the peripheral fixed contacts 30A and 30B.

When, by means of the plunger 28, the user exerts a force on the convex upper face 27 of the triggering dome, in the vertical direction of the arrow F in FIG. 5 (this force being substantially centred on the vertical axis VA), given the relative elasticities and stiffnesses of the triggering dome and the spring 24, the first pressure force exerted on the triggering dome 26 may cause no elastic deformation of the triggering dome which, bearing on the rigid section 44, initially causes elastic deformation of the return spring 24.

This deformation of the spring 24 may cause rocking of the triggering dome 26 leading to bearing engagement and electrical contact of its lower edge 54 with the coplanar upper faces 34A, 34B of the peripheral fixed contacts 30A and 30B.

The triggering dome 26 may thus be moved from its initial high rest position shown in FIG. 5 (toward which it is urged elastically by the spring 24) toward its low final switching position in which its annular peripheral edge 54 bears on the two first peripheral fixed contacts 30A, 30B to make the first electrical switchpath between those contacts and therefore between the terminals 32A and 32B.

At the end of the actuation first phase, the spring 24 may be substantially "flat" and the triggering dome 26 is in a "classic" position in which its lower peripheral annular area bears on a horizontal plane to enable thereafter its "classic" sudden change of state.

Then, on continuing application of a push force of higher value in the direction of the arrow F, the user may cause elastic deformation of the triggering dome 26 and its sudden change of state, as known in the art. At the end of this deformation, the conductive lower face of the central part of the triggering dome 26 may come into electrical contact with the upper face 40 of the central fixed contact 36.

Apart from the tactile sensation that it gives the user, this deformation may then make the second electrical switchpath between the central fixed contact 36 and the peripheral fixed contacts 30A and 30B, i.e. between the connecting terminals 38A, 38B and 32A, 32B.

For example, for a triggering dome 26 with a diameter of 2 mm, the first actuating stroke is equal to approximately 0.1 mm with a force of 1 Newton while the second actuating stroke is equal to approximately 0.2 mm with an actuating force equal to 2.5 Newtons.

The peripheral annular area and/or the lower free edge 54 of the triggering dome 26, via its conductive lower face, may make directly the electrical contact between the two fixed contacts 30A.

The invention is not limited to the two embodiments that have just been described. For example, the fixed contacts may be part of a rigid or flexible printed circuit board. Nor is the invention limited to two fixed peripheral contacts. The annular return spring 24 may be associated with the lower face of a triggering dome 26.

The design of the invention that has just been described is particularly compact as much in height as laterally, the height being only increased (relative to a standard single-action dome switch) by the thickness or vertical height necessary for the deformation of the return spring.

The invention is not limited to a switch actuated by a vertical plunger, and may also find applications with lateral actuation with a movement direction-changer along the vertical axis to act at the centre of the triggering dome 26.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

The invention claimed is:

1. A double-action tactile-effect electrical switch comprising:

an insulative support, an upper face of which that lies in a horizontal plane and carries at least three fixed electrical contacts comprising:

a peripheral first contact, a peripheral second contact, and a central third contact; and a triggering member, which is elastically deformable from a stable rest state by the action of an actuating member acting in a vertical direction, the triggering member comprising a lower peripheral annular area adapted to come simultaneously into bearing engagement with the two first peripheral contacts to make a first switchpath, and a domed upper central section on which the actuating member acts, wherein the domed upper central section is deformable in order to make an electrical connection between the two fixed first contacts and the central third electrical contact, to make a second switchpath consecutively to the making the first switchpath;

wherein, in its stable rest state, the triggering member occupies either:

an initial high rest position toward which it is urged elastically and in which the annular area does not bear on the two peripheral fixed first contacts; or a final low switching position toward which it is moved by the actuating member, against a return spring force, and in which the annular area of the triggering member bears directly or indirectly on the two first peripheral fixed contacts, wherein the switch includes a spring disposed vertically between the support and the triggering member and which is compressible vertically to enable the triggering member to move from its initial high position to its final low position, and wherein, in the initial high position of the triggering member, the lower peripheral edge that delimits the annular area lies in a plane that forms an acute angle with the horizontal plane, and, in the low final position, the lower peripheral edge lies in a plane parallel to the horizontal plane and bears on the two first peripheral fixed contacts.

2. The switch according to claim 1, wherein the spring is a ring that includes a rigid bearing section on which a section of the lower peripheral edge bears and an elastically deformable section, the ring being elastically deformable between a stable rest state in which the rigid section lies in a plane that forms an acute angle with the horizontal plane and an elastically compressed final state in which the rigid section extends horizontally and bears on the horizontal upper face.

3. The switch according to claim 2, wherein the elastically deformable section of the return ring includes two elastically deformable branches which join at a point that bears on the horizontal upper face situated between the two first peripheral fixed contacts.

4. The switch according to claim 1, wherein the triggering member is a spherical dome.

5. The switch according to claim 1, wherein the switch further comprises a contact support for the contacts that delimits a housing, a bottom of which is delimited by the horizontal upper surface.

* * * * *